US012331936B1

(12) United States Patent
Dong et al.

(10) Patent No.: US 12,331,936 B1
(45) Date of Patent: Jun. 17, 2025

(54) ELECTRIC FIREPLACE WITH VARIABLE COVER PLATE

(71) Applicant: NINGBO MANXING TECHNOLOGY CO., LTD., Ningbo (CN)

(72) Inventors: Qi Dong, Ningbo (CN); Yizhen Wang, Ningbo (CN)

(73) Assignee: NINGBO MANXING TECHNOLOGY CO., LTD., Ningbo (CN)

( * ) Notice: Subject to any disclaimer, the term of this patent is extended or adjusted under 35 U.S.C. 154(b) by 0 days.

(21) Appl. No.: 19/057,338

(22) Filed: Feb. 19, 2025

Related U.S. Application Data

(63) Continuation of application No. PCT/CN2024/103573, filed on Jul. 4, 2024.

(30) Foreign Application Priority Data

Jun. 6, 2024 (CN) ..... 202410730202.5

(51) Int. Cl.
*F24C 7/00* (2006.01)

(52) U.S. Cl.
CPC ..... *F24C 7/004* (2013.01)

(58) Field of Classification Search
CPC ..... F24C 7/004
See application file for complete search history.

(56) References Cited

U.S. PATENT DOCUMENTS

| | | | | |
|---|---|---|---|---|
| 12,025,281 | B1 * | 7/2024 | Lin | F21S 10/046 |
| 2018/0017261 | A1 * | 1/2018 | Bolton | F24B 1/19 |
| 2019/0137059 | A1 * | 5/2019 | Zhou | F24B 1/1808 |
| 2020/0224842 | A1 * | 7/2020 | Yao | F21V 14/06 |
| 2023/0175660 | A1 * | 6/2023 | Lassen | F21S 10/046 362/234 |
| 2023/0204172 | A1 * | 6/2023 | Walker | F24C 7/004 392/348 |

FOREIGN PATENT DOCUMENTS

| | | | |
|---|---|---|---|
| CN | 101586773 | A | 11/2009 |
| CN | 102679258 | A | 9/2012 |
| CN | 218915082 | U | 4/2023 |

* cited by examiner

*Primary Examiner* — Bryon T Gyllstrom

(57) ABSTRACT

The disclosure presents an electric fireplace having a housing, an interior chamber for housing simulated fuel, and a variable cover plate for sealing the interior chamber. The variable cover plate comprises an outer transparent medium and a variable film provided with a wire contact module. The variable film abuts the outer transparent medium via colloid; the wire contact module extends laterally from the variable film to connect to an electronic control system. The electronic control system is disposed on the housing and outside the back of the interior chamber. The electronic control system alters the appearance of the charcoal and flames on the variable cover plate by adjusting the fuzzy coefficient of the variable film. As a result, users can create various desired states, thus enhancing customization and user experience of the electric fireplace.

9 Claims, 14 Drawing Sheets

ELECTRIC FIREPLACE WITH VARIABLE COVER PLATE

CROSS-REFERENCE TO RELATED APPLICATIONS

The application claims priority to Chinese patent application No. 202410730202.5, filed on Jun. 6, 2024, the entire contents of which are incorporated herein by reference.

BACKGROUND

The present disclosure relates to a technical field of electric fireplaces and more particularly to an electric fireplace.

As people's living standards improve, the demand for indoor decoration rises. Thus, electric fireplaces, as decoration, are gradually and popularly entering thousands of households. However, the electric fireplaces in the prior art, are relatively monotonous in flame imaging, resulting in a poor visual experience. In order to improve the visual experience, two approaches are generally adopted. One is to add a display device behind simulated fuel of the electric fireplace or to change the type of simulated fuel, so as to display flames of varying brightness on the imaging screen of the electric fireplace. The other is to configure the imaging screen itself into different zones with different light and shadow effects, exhibiting flames of varying brightness.

If the first approach is adopted, the internal structure of the electric fireplace would become complicated. If the second approach is adopted, the brightness of the flames displayed on the imaging screen of the electric fireplace is fixed and cannot be changed.

SUMMARY

The purpose of the present disclosure is to solve the above problems in the prior art and to provide an electric fireplace having a relatively simple structure and diverse brightness that is changeable.

The purpose of the present disclosure can be achieved by the following technical solutions: an electric fireplace, comprising:

a housing having an interior chamber for housing simulated fuel and a variable cover plate for sealing or covering an opening of the interior chamber, and the variable cover plate comprises at least an outer transparent medium provided with light-transmitting properties, a variable film connected to the outer transparent medium and a wire contact module extending outward from the variable film;

an electronic control system disposed in the housing and on the back of the interior chamber, the electronic control system being electrically connected to the wire contact module, wherein, a fuzzy coefficient of the variable film is controlled by the electronic control system, so as to manifest various states of flames on the outer transparent medium.

In the electronic fireplace as set forth, the wire contact module and the electronic control system are electrically connected through a plug-in method or a wireless transmission method.

In the electronic fireplace as set forth, the wire contact module comprises a base plate and a pin disposed on the base plate, and the housing comprises an interface for matching the pin.

In the electronic fireplace as set forth, an elastic component is arranged between the base plate and the pin, with two ends of the elastic component connected to the base plate and to the pin, respectively. An elastic force is obtained by the pin due to the elastic component, or a magnet is disposed between the base plate and the pin.

In the electronic fireplace as set forth, the housing further comprises a safety button that forms a contact-type abutting connection to the variable cover plate. When the variable cover plate is released from the abutment connection with the safety button, the power is cut off between the wire contact module and the interface, and the electronic control system stops supplying power to the wire contact module.

In the electronic fireplace as set forth, the variable cover plate further comprises an inner transparent medium, and the variable film is sandwiched between the inner transparent medium and the outer transparent medium. A through-hole is disposed on the inner transparent medium, serving as a routing channel for wires of the wire contact module. Alternatively, in one of the embodiments of the present disclosure, the wires of the wire contact module are led outward through a gap between the inner transparent medium and the outer transparent medium.

In the electronic fireplace as set forth, a connecting rack is disposed on the inner transparent medium, and a first fixing plate and a plurality of notches are disposed on the connecting rack in sequence, along an axial direction of the connecting rack. The plurality of notches snap fits with a plurality of snap joints on the housing, and the first fixing plate is configured to be connected to a second fixing plate on the housing by a fastener. Alternatively, in one of the embodiments of the present disclosure, the connecting rack is disposed on the outer transparent medium, and the variable film is connected to the inner transparent medium, forming an integrated plate configured to be mounted on a frame.

In the electronic fireplace as set forth, the plurality of notches comprises a first notch and a second notch. One side of the first notch is disposed perpendicularly to the axial direction, while the other side is disposed of obliquely, such that the opening of the first notch faces diagonally downward. The second notch is U-shaped, with the opening facing downward. A depth difference is designed between the two sides of the second notch.

In the electronic fireplace as set forth, the housing comprises a connection strip disposed adjacent to a side of the housing. The connection strip comprises a mounting hole for receiving a fastener, allowing for fixing the housing to a wall by passing the fastener through the mounting hole, and the mounting direction between the first fixing plate and the second fixing plate coincidences with the mounting direction between the housing and the wall, both facing a front side of the housing.

In the electronic fireplace as set forth, the electric fireplace further comprises a decorative cover plate that is detachably connected to the housing. The decorative cover plate is configured for covering a tail end of the fastener mounted at the connection joint of the first fixing plate and the second fixing plate, and a tail end of the fastener mounted at the connection joint of the housing and the wall.

Compared with the electric fireplaces in the prior art, the electric fireplace proposed in the present disclosure has beneficial effects as follows:

1. The electric fireplace provided in the present disclosure is capable of displaying different states required by users on the outer transparent medium by attaching a layer of variable film to the outer transparent medium and by controlling the fuzzy coefficient of the variable film. The electric fireplace offers a high degree of customization and is flexible to use, thereby improving the user experience.

2. By incorporating an elastic component or a magnet, the pin is transformed into an elastic pin or a magnetic pin, respectively. When the pin is plugged into the interface, the elastic pin or the magnetic pin obtains sufficient positive and negative tolerances horizontally, vertically, and in a depth direction. On one hand, it ensures that the pin can be reliably connected to the interface. On the other hand, a safe electrical distance between the pin and the interface is guaranteed when workers assemble the variable cover plate.

3. By using the inner transparent medium and placing the variable film between the inner transparent medium and the outer transparent medium, the variable film is protected, thereby the safety of the variable cover plate is improved during the disassembly and reassembly process.

4. The pre-positioning of the variable cover plate on the housing is achieved by snap fitting the first notch and the first snap, as well as by snap fitting the second notch and the second snap. The variable cover plate is installed and affixed to the housing by fastening the first fixing plate of the variable cover plate to the second fixing plate of the housing. Since the variable cover plate can be mounted and unmounted from the front side of the housing, disassembling and assembling the variable cover plate is more convenient.

5. Due to the shape of the second notch, the variable cover plate is capable of rotating around the housing when the second notch and the second snap are fitted together. And no interference between the variable cover plate and the housing occurs during the rotation. Due to the shape of the first notch, a secure snap fit between the first notch and the first snap is completed after the variable cover plate rotates from an inclined position to a vertical position relative to the housing, thus enhancing the convenience of disassembling and assembling the variable cover plate.

Figure 1:
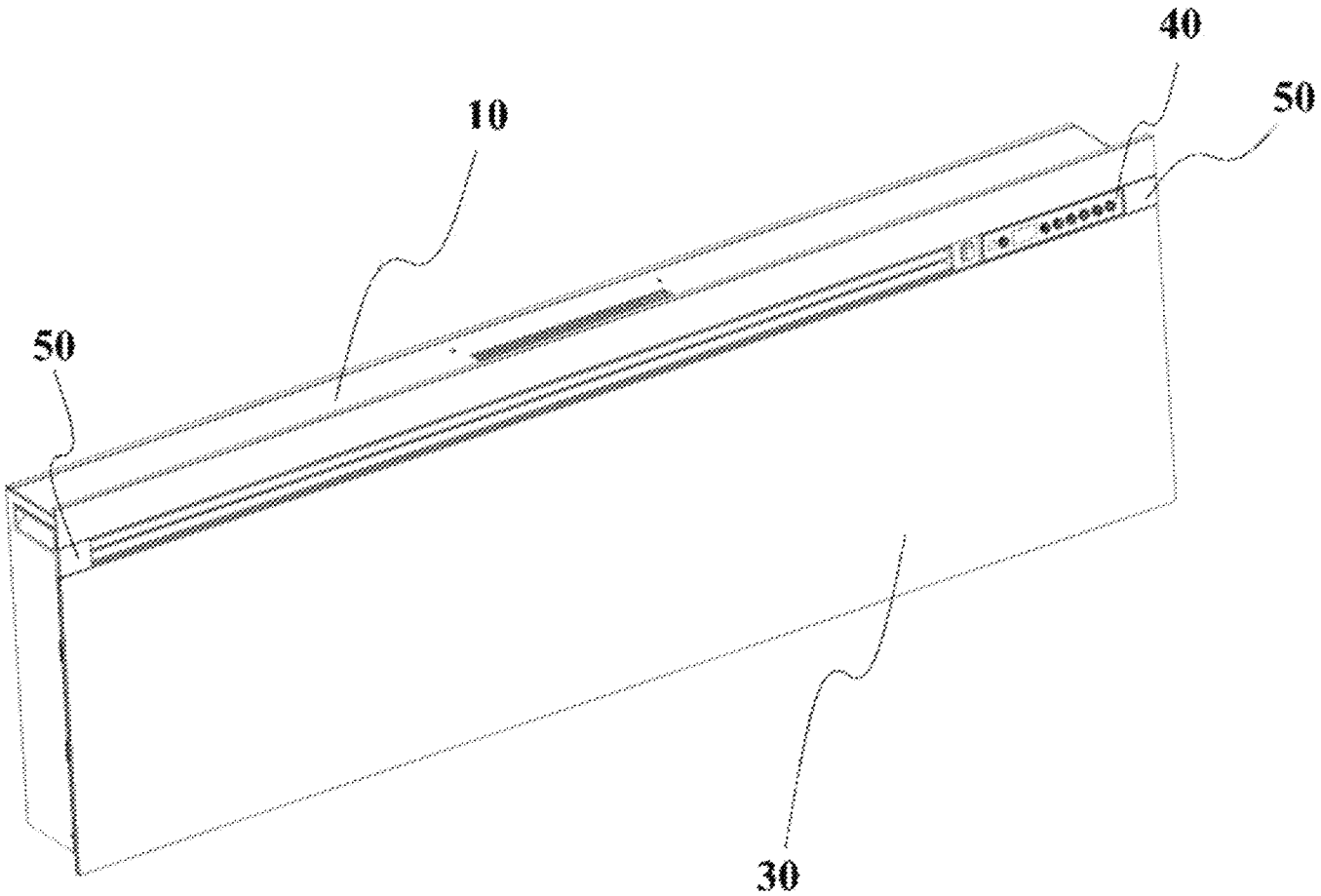
FIG. 1 is a schematic diagram illustrating the structure of an electric fireplace in one of the embodiments of the present disclosure, featuring a variable cover plate mounted on the housing.
Figure 2:
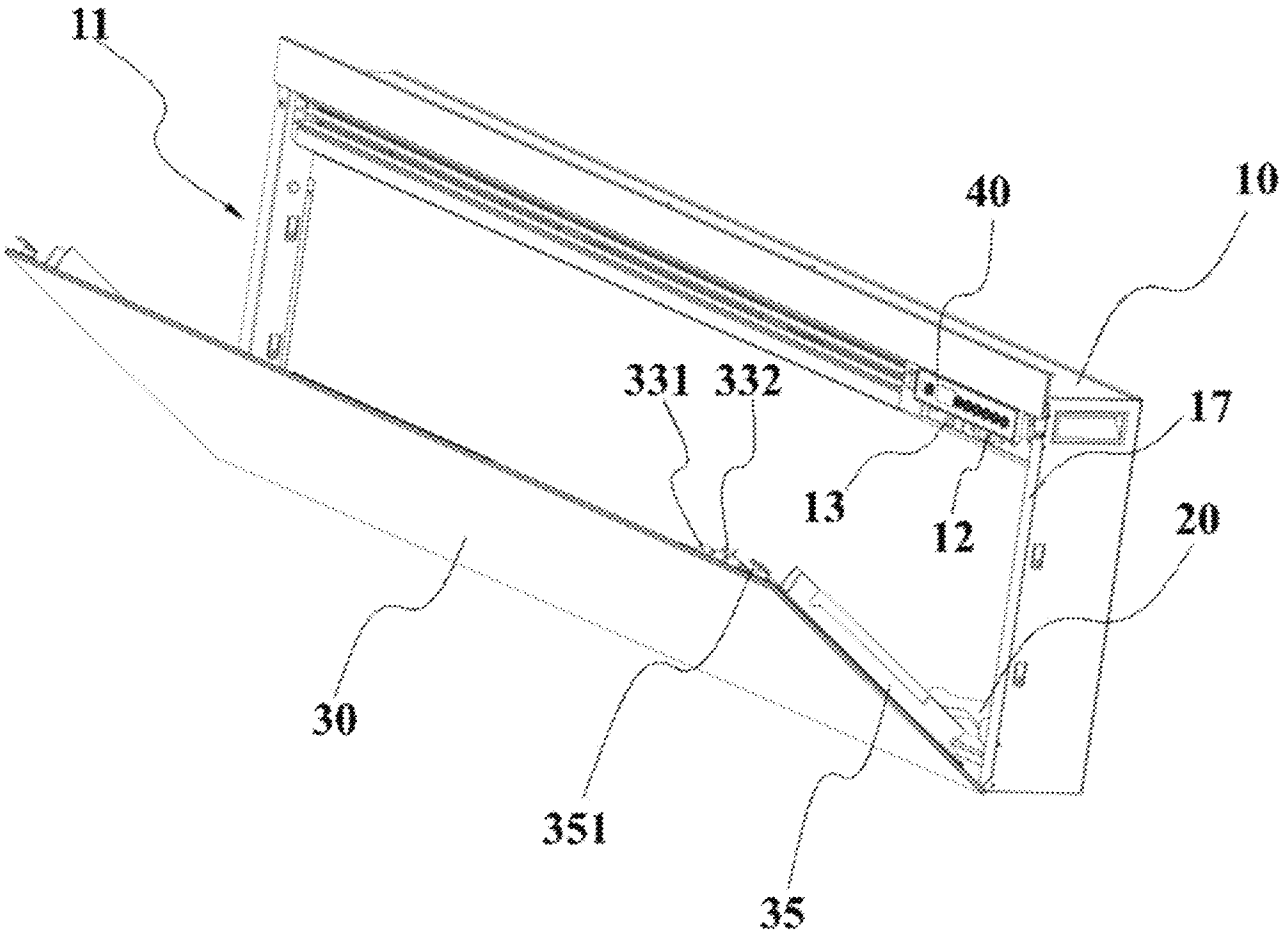
FIG. 2 is a schematic diagram illustrating the structure of an electric fireplace in one of the embodiments of the present disclosure, featuring a variable cover plate in a half-mounted position to the housing.
Figure 3:
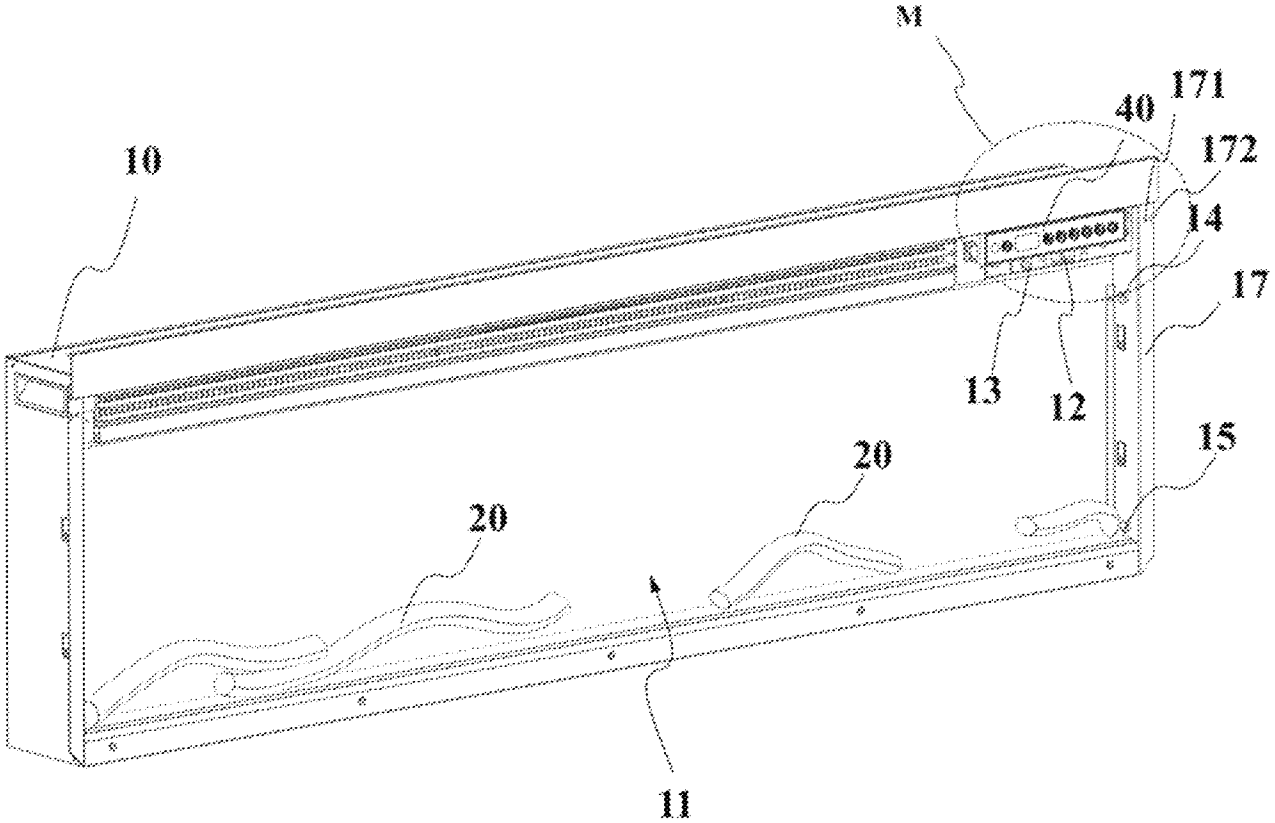
FIG. 3 is a schematic diagram of a housing of an electric fireplace in one of the embodiments of the present disclosure.
Figure 4:
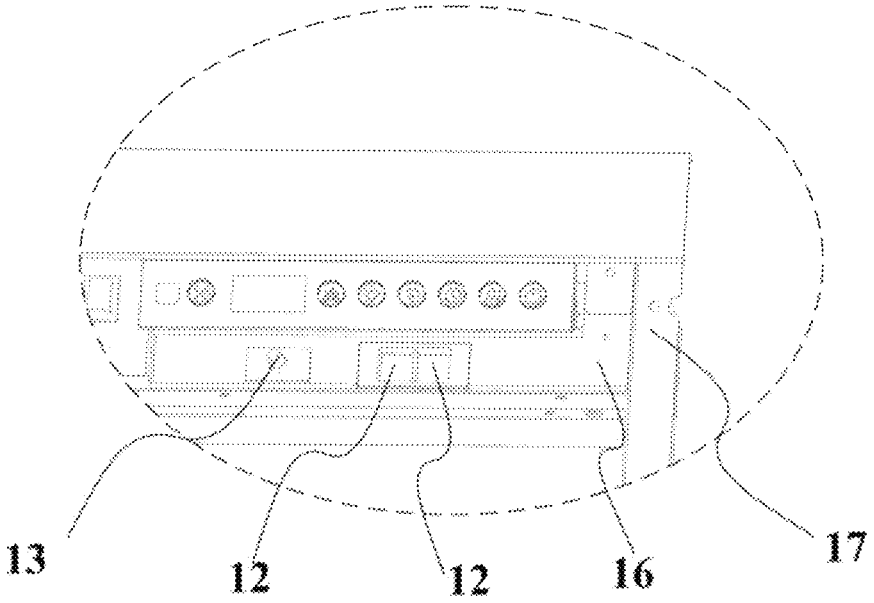
FIG. 4 shows a local enlarged view of part M in FIG. 3.
Figure 5:
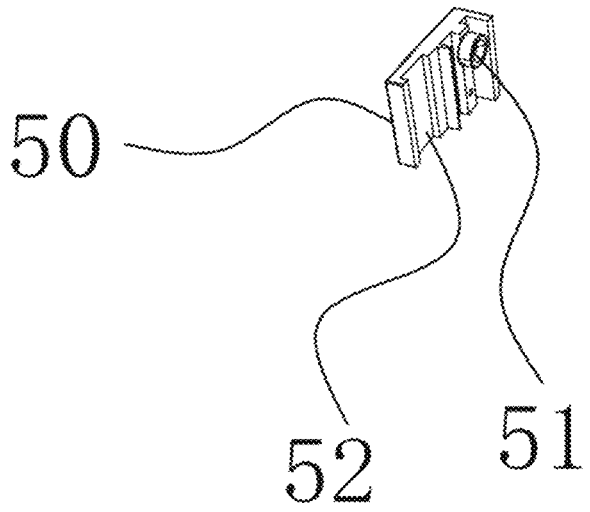
FIG. 5 is a schematic diagram of the back of a decorative cover plate according to one embodiment of the present disclosure.
Figure 6:
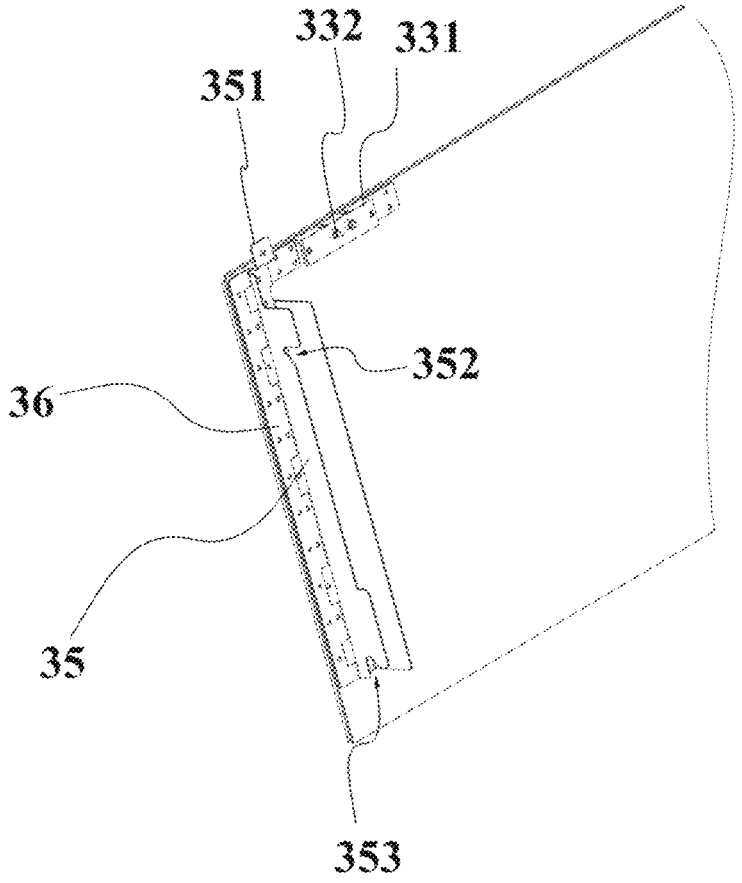
FIG. 6 is a schematic view of a partial structure of the back side of a variable cover plate of an electric fireplace in one of the embodiments of the present disclosure.
Figure 7:
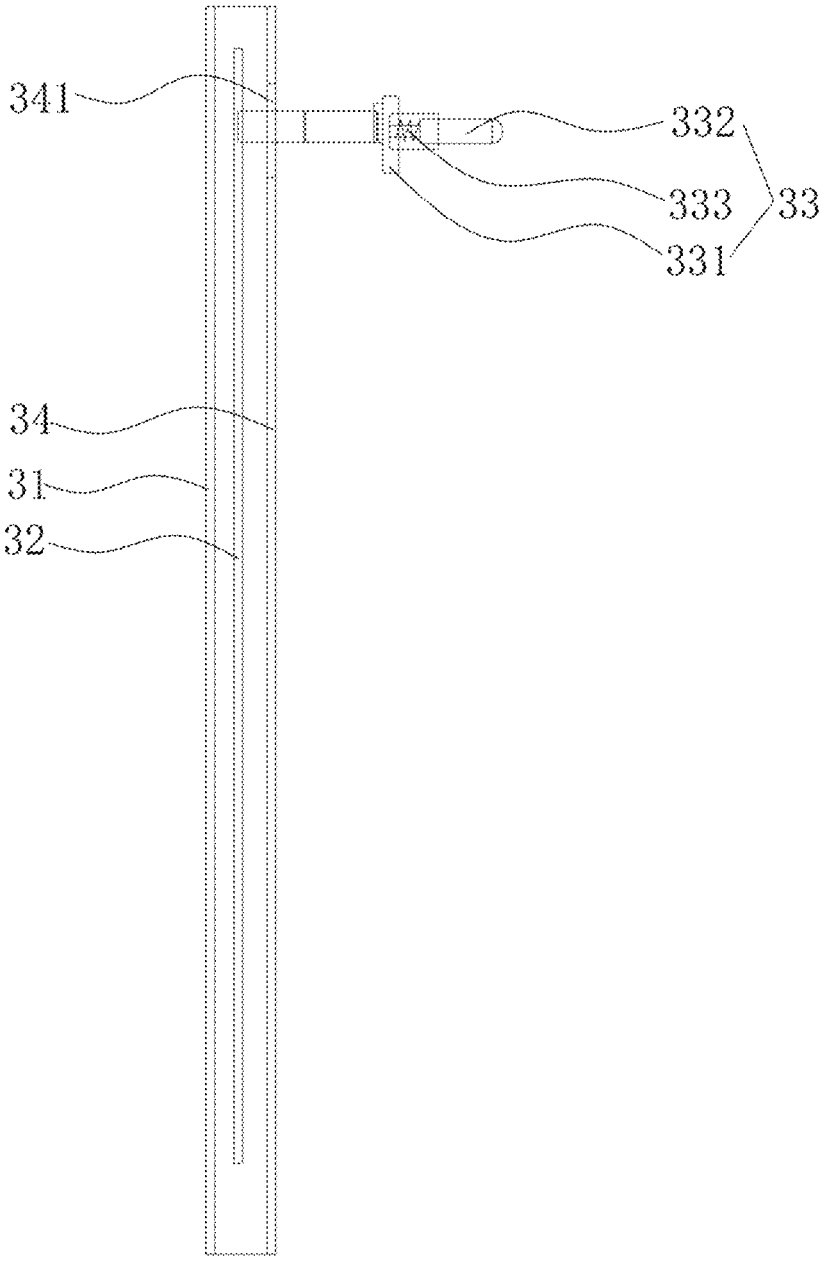
FIG. 7 is a schematic diagram of a variable cover plate provided with a wire contact module in one of the embodiments of the present disclosure.
Figure 8:
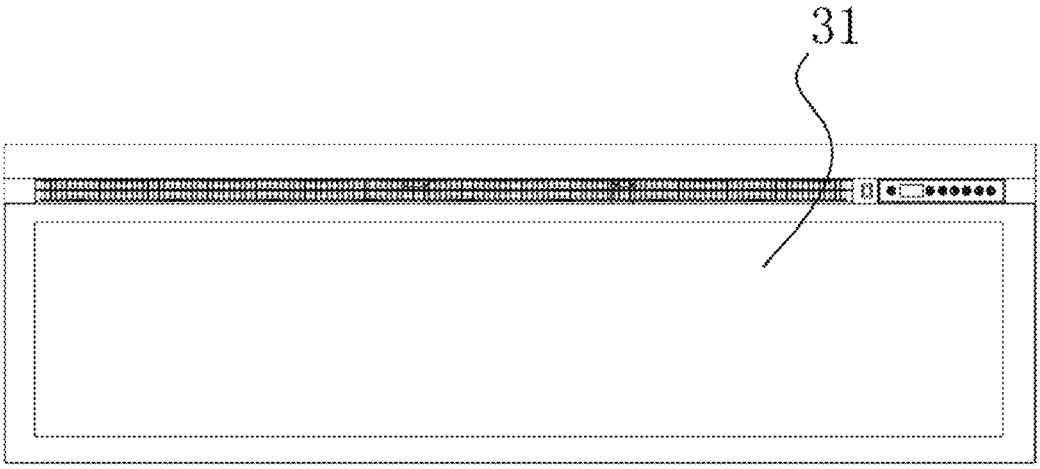
FIG. 8 is a schematic diagram of an electric fireplace where the variable cover plate is in a "black screen" state in one of the embodiments of the present disclosure.
Figure 9:
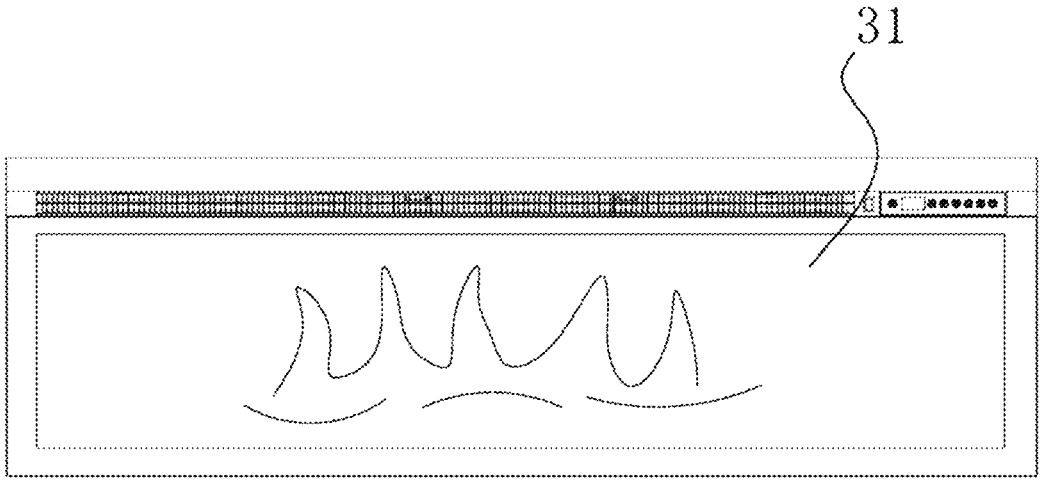
FIG. 9 is a schematic diagram of an electric fireplace where the variable cover plate only displays flame in one of the embodiments of the present disclosure.
Figure 10:
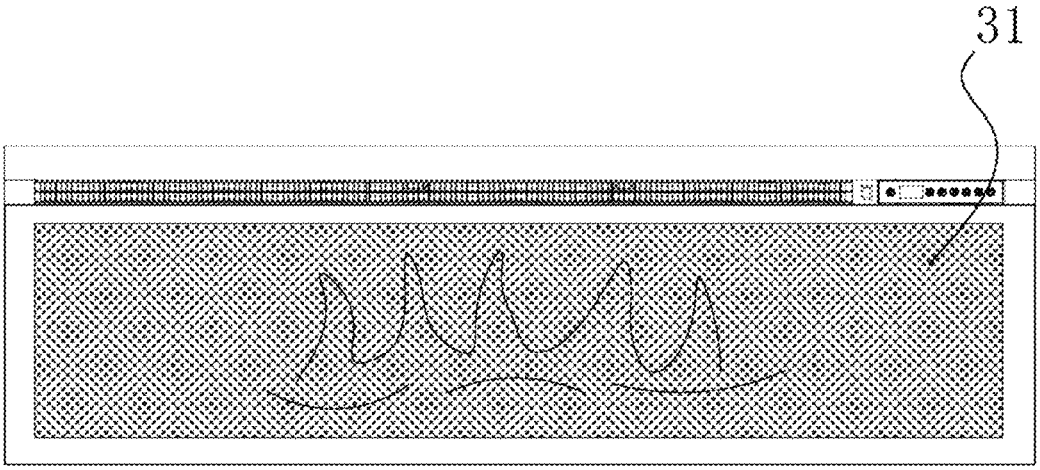
FIG. 10 is a schematic diagram of an electric fireplace where the whole variable cover plate is fuzzy in one of the embodiments of the present disclosure.
Figure 11:
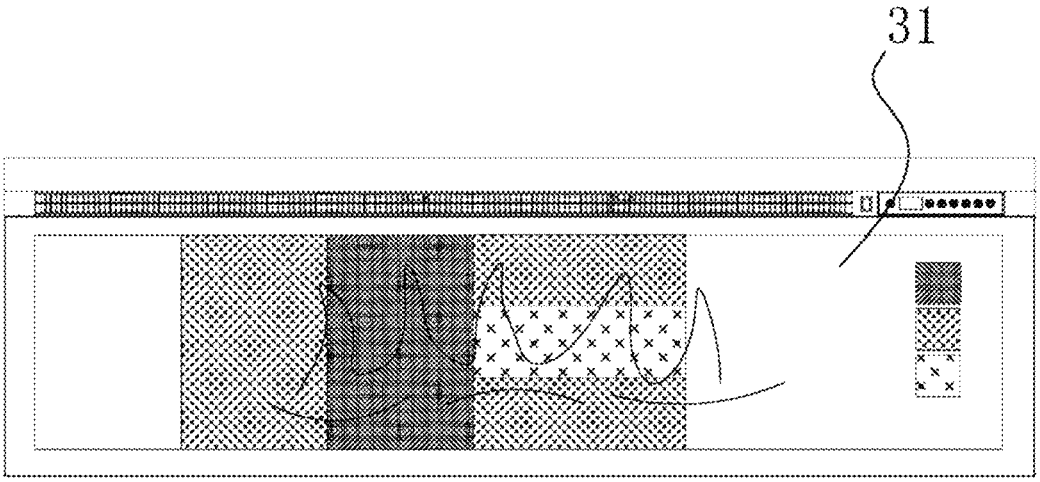
FIG. 11 illustrates a schematic diagram of an electric fireplace where certain sections of the variable cover plate appear fuzzy in one of the embodiments of the present disclosure.

The following reference numbers are used in the drawings: 10. Housing; 11. Interior chamber; 12. Interface; 13. Safety button; 14. First snap; 15. Second snap; 16. Second fixing plate; 17. Connection strip; 171. Mounting hole; 172. Notch; 20. Simulated fuel; 30. Variable cover plate; 31. Outer transparent medium; 32. variable film; 33. Wire contact module; 331. Base plate; 332. Pin; 333. Elastic component; 34. Inner transparent medium; 341. Through-hole; 35. Connecting rack; 351. First fixing plate; 352. First notch; 353. Second notch; 36. Stiffening plate; 40. Electronic control system; 50. Decorative cover plate; 51. Fixing notch; 52. Receiving notch; 37. Frame; 38. Integrated plate.

DETAILED DESCRIPTION OF THE EMBODIMENTS

The following are specific embodiments of the present disclosure, which are described in further detail with the accompanying drawings. However, it does not mean the present disclosure is limited to these embodiments.

It should be noted that all directional indications in the embodiments of the present disclosure (such as up, down, left, right, front, back, etc.) are only used to describe relative positional relationships, movement status, etc., between components under a specific orientation (as shown in the accompanying drawings.) If the specific orientation changes, the directional indications will also change accordingly.

Embodiment I

As shown in FIG. 1 to FIG. 11, an electric fireplace provided by the present disclosure, comprising:

a housing 10 comprising an interior chamber 11 disposed in the housing 10 for housing simulated fuel 20 and a variable cover plate 30 for sealing an opening of the interior chamber 11, the simulated fuel 20 includes simulated charcoal, simulated ice, simulated leaves, simulated branches, simulated tree roots, etc., and the variable cover plate 30 comprises at least an outer transparent medium 31 having light-transmitting properties, a variable film 32 connected to the outer transparent medium 31 via gel, and a wire contact module 33 extended outward from the variable film 32; and an electronic control system 40 disposed in the housing 10 and on the back of the interior chamber 11, the electronic control system 40 being electrically connected to the wire contact module 33; and the electronic control system 40 controls a fuzzy coefficient of the variable film 32 to display various states of the flames and the simulated fuel 20 on the outer transparent medium 31.

It is worth noting that, when the simulated fuel 20 is lit, by controlling the fuzzy coefficient of the variable film 32, the outer transparent medium 31 would be in a "black screen" state, so that the user cannot see either the simulated fuel 20 or the flame through the outer transparent medium 31, or the user might see the flame but not the simulated fuel 20; Alternatively, the outer transparent medium 31 would be in a "global blur screen" state, in which the flame appears blurred on the outer transparent medium 31, allowing the user to view a blurred flame, which gives a hazy beauty; Alternatively, the outer transparent medium 31 would be in a "partial blur screen" state, in which the outer transparent medium 31 is blurred sectionally, and the blur degree can be different among different sections of the screen.

Additionally, besides via gel, the variable film 32 can be connected to the outer transparent medium 31 by other methods, for example, by fasteners.

In addition, the variable film 32 is dynamically adjustable, which is a photovoltaic film made by mixing polarized crystal particles and polymer mixtures, capable of infinitely adjusting the light transmission rate under voltage, leading to effects of heat insulation, energy saving, temperature control, shading, privacy and so on.

In the electric fireplace provided by the present disclosure, by adhering a layer of variable film 32 to the outer transparent medium 31 and by controlling the fuzzy coefficient of the variable film 32, different states required by users could be presented on the outer transparent medium 31, which has a high degree of customization and is flexible to use, thus improving the user experience.

Preferably, the wire contact module 33 and the electronic control system 40 are electrically connected through a plug-in connection, in which the connection direction is either horizontal or vertical, where the plug-in connection direction is aligned with the assembly direction of the variable cover plate 30, when the variable cover plate 30 is mounted horizontally on the housing 10, the plug-in connection is horizontal; when the variable cover plate 31 is mounted vertically on the housing 10, the plug-in connection is vertical.

It is worth noting that, the direction of plug-in connection between the wire contact module 33 and the electronic control system 40 is not limited to being horizontal or vertical, where an angle between the plug-in connection of the wire contact module 33 and the electronic control system 40 relative to horizontal level can vary from 0 to 90°.

Also, in the embodiments described above, the wire contact module 33 and the electronic control system 40 are electrically connected via a plug-in connection, which means that the electrical connection is realized by mechanical contact. In other embodiments of the present disclosure, the electric connection between the wire contact module 33 and the electronic control system 40 is realized via wireless transmission. For instance, a wireless signal receiving device is disposed on the wire contact module 33, and a wireless signal transmitting device is disposed on the electronic control system 40, allowing for a wireless signal transformation between the two.

Further, the wire contact module 33 comprises a base plate 331 and a pin 332 disposed on the base plate 331, and an interface 12 is disposed on the housing 10 for plugging and matching the pin 332.

Further, an elastic component 333 is disposed between the base plate 331 and the pin 332, and two ends of the elastic component 333 are respectively connected to the base plate 331 and the pin 332, where the pin 332 obtains an elastic force due to the elastic component 333, or a magnet is provided between the base plate 331 and the pin 332.

In one of the embodiments of the present disclosure, by providing an elastic component 333 or a magnet, the pin 332 is formed into an elastic pin 332 or a magnetic pin 332. When the pin 332 is plugged into and matches with the interface 12, a sufficient positive/negative tolerance is obtained for the elastic pin 332 or the magnetic pin 332, both in a longitudinal direction and in a transverse direction. On one hand, it ensures that the pin 332 can be reliably inserted into the interface 12, and on the other hand, a safe electricity distance is ensured between the pin 332 and the interface 12 during assembly of the variable cover plate 30.

Preferably, in order to further enhance the safety of disassembly and assembly of the variable cover plate 30 and the safety of using the electric fireplace, a safety button 13 is disposed on the housing 10, forming a contact-type abutment match with the variable cover plate 30. when the safety button 13 is released from abutment with the variable cover plate 30, the power between the wire contact module 33 and the interface 12 is cut off, thereby stopping the electronic control system 40 from supplying power to the wire contact module 33; when the wire contact module 33 and the interface 12 complete the electrical plug-in connection, the variable cover plate 30 forms a contact-type abutment match with the safety button 13. At this point, the wire contact module 33 and the interface 12 are powered on, and the electronic control system 40 supplies power to the wire contact module 33.

Preferably, the variable cover plate 30 further comprises an inner transparent medium 34 having light-transmitting properties, and the variable film 32 is sandwiched between the inner transparent medium 34 and the outer transparent medium 31. And a through-hole 341 is disposed on the inner transparent medium 34 for routing the wires on the wire contact module 33.

In this embodiment, the inner transparent medium 34 is designed for protection of the variable film 32, the variable film 32 being disposed between the inner transparent medium 34 and the outer transparent medium 31. Thus the safety of the variable cover plate 30 is also improved during the disassembly and assembly process.

Preferably, a connecting rack 35 is disposed on the variable cover plate 30, on both the left and the right sides of the variable cover plate 30. The first fixing plate 351, the first notch 352, and the second notch 353 are disposed on each connecting rack 35 along a longitudinal direction in sequence, and the first notch 352 is snap-fitted with a first snap 14 of the housing 10, the second notch 353 is snap-fitted with a second snap 15 of the housing 10, and the first fixing plate 351 is connected to the second fixing plate 16 of the housing 10 by a fastener.

In this embodiment, the pre-positioning of the variable cover plate 30 on the housing 10 is achieved through the snap-fitting between the first notch 352 and the first snap 14 and through the second notch 353 and the second snap 15. The first fixing plate 351 is fixedly connected to the second fixing plate 16 by fasteners, therefore achieving the installation of the variable cover plate 30 to the housing 10. The variable cover plate 30 is mounted on and dismounted from the front side of the housing 10, leading to a relatively more convenient assembly and disassembly of the variable cover plate 30.

Furthermore, since one side of the first notch 352 is positioned horizontally and the other side is angled diagonally, the opening of the first notch 352 faces diagonally downward. The second notch 353 is designed in U-shape, and the opening direction is designed downward. There is a height difference on two sides of the opening of the second notch 353.

It is worth noting that in mounting the variable cover plate 30, the first step is to snap fit the second notch 353 and the second snap 15, then rotate the variable cover plate 30 such that the first notch 352 snaps fit the first snap 14. In this way, the variable cover plate 30 is pre-positioned on the housing 10, and the first fixing plate 351 is aligned with the second fixing plate 16. Finally, the variable cover plate 30 is installed by connecting the first fixing plate 351 to the second fixing plate 16 through fasteners.

It can be seen that in this embodiment, the second notch 353 can rotate around the second snap 15 after being snap-fitted. And because of the designed shape of the second notch 353, no interference occurs between the variable cover plate 30 and the housing 10 while rotating. Further, due to the shape of the first notch 352, the first snap 14 can reliably snap-fit to the first notch 352 by rotating the variable cover plate 30 around the housing 10 from a tilted state to a vertical state.

In one of the embodiments of the present disclosure, the variable cover plate 30 is connected to the connecting rack 35 via gel. To further improve entire strength of the variable cover plate 30, a stiffening plate 36 is disposed on an inner edge of the variable cover late 30, the stiffening plate 36 being connected to the variable cover plate 30 via gel, too.

Preferably, the housing 10 is provided with a connection strip 17, and the connection strip 17 is adjacent to a side wall of the housing 10, and a mounting hole 171 is disposed in the connection strip 17 for receiving a fastener, allowing the housing 10 to be fixed to a wall by passing the fastener through the mounting hole 171.

It is worth noting that, the mounting direction between the first fixing plate 351 and the second fixing plate 16 is consistent with the mounting direction between the housing 10 and the wall, both facing the front side of the housing 10, and the mounting point of the first fixing plate 351 and the second fixing plate 16 is alongside with the mounting point of the housing 10 and the wall.

Further, the appearance of the electric fireplace is influenced by the fasteners that are used for connecting the first fixing plate 351 to the second fixing plate 16 and for connecting the housing 10 to the wall, because the tails of the fasteners are in an exposed state. Therefore, the electric fireplace further comprises a decorative cover plate 50 that is detachably connected to the housing 10. The tail of the fastener at the joint of the first fixing plate 351 and the second fixing plate 16 and the tail of the fastener at the joint of the housing 10 and the wall, are covered by the decorative cover plate 50, thus enhancing the overall aesthetics of the electric fireplace.

Further, the decorative cover plate 50 is magnetically connected to the housing 10.

It is worth noting that, for making the surface of the electric fireplace flat, where the variable cover plate 30 is disposed, the decorative cover plate 50 is embedded between the variable cover plate 30 and the housing 10. Although such a structure ensures the flatness of the surface of the electric fireplace, it is not conducive to removing the decorative cover plate 50, and therefore, in order to facilitate the dismantling of the decorative cover plate 50, a notch 172 is disposed at a back of the decorative cover plate 50 or at an edge of the connection strip 17, so the user can remove the embedded decorative cover plate 50 from the electric fireplace through the notch 172.

Further, a fixing notch 51 is disposed on the back of the decorative cover plate 50 for mounting a magnet, and a receiving notch 52 is disposed for receiving the end of the fastener.

Embodiment II

Figure 12:
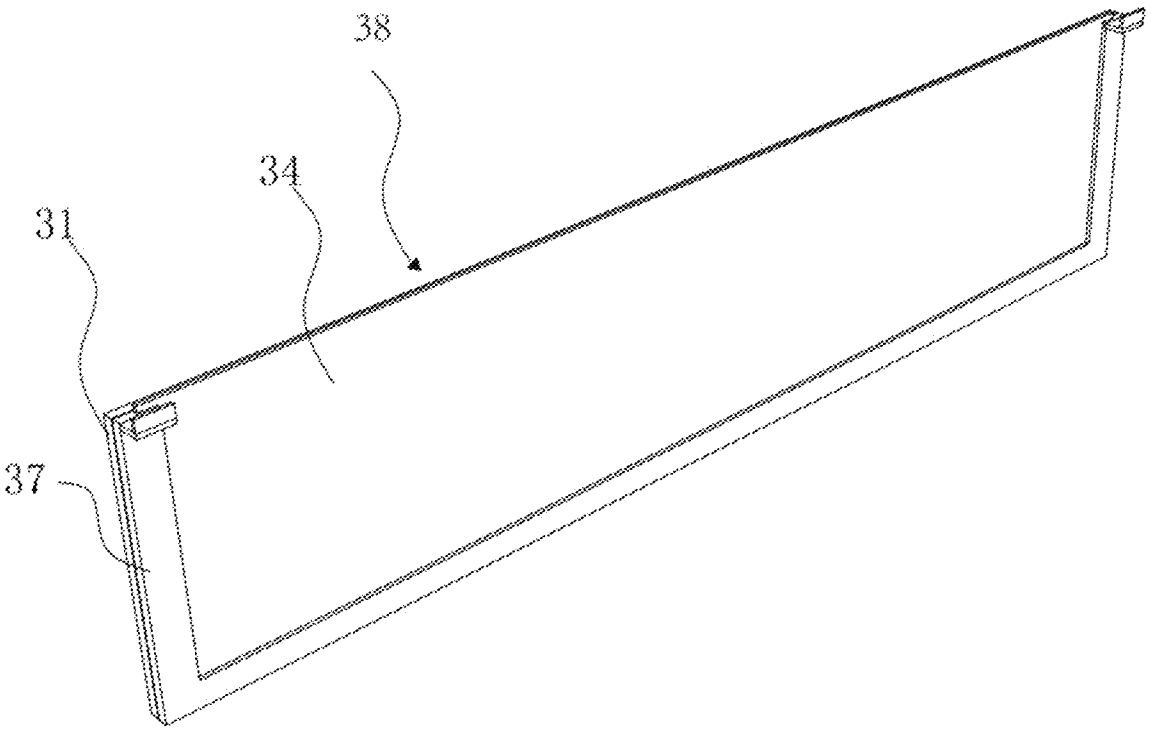
FIG. 12 is a schematic diagram of a variable cover plate provided with an integrated plate in another embodiment of the present disclosure.
Figure 13:
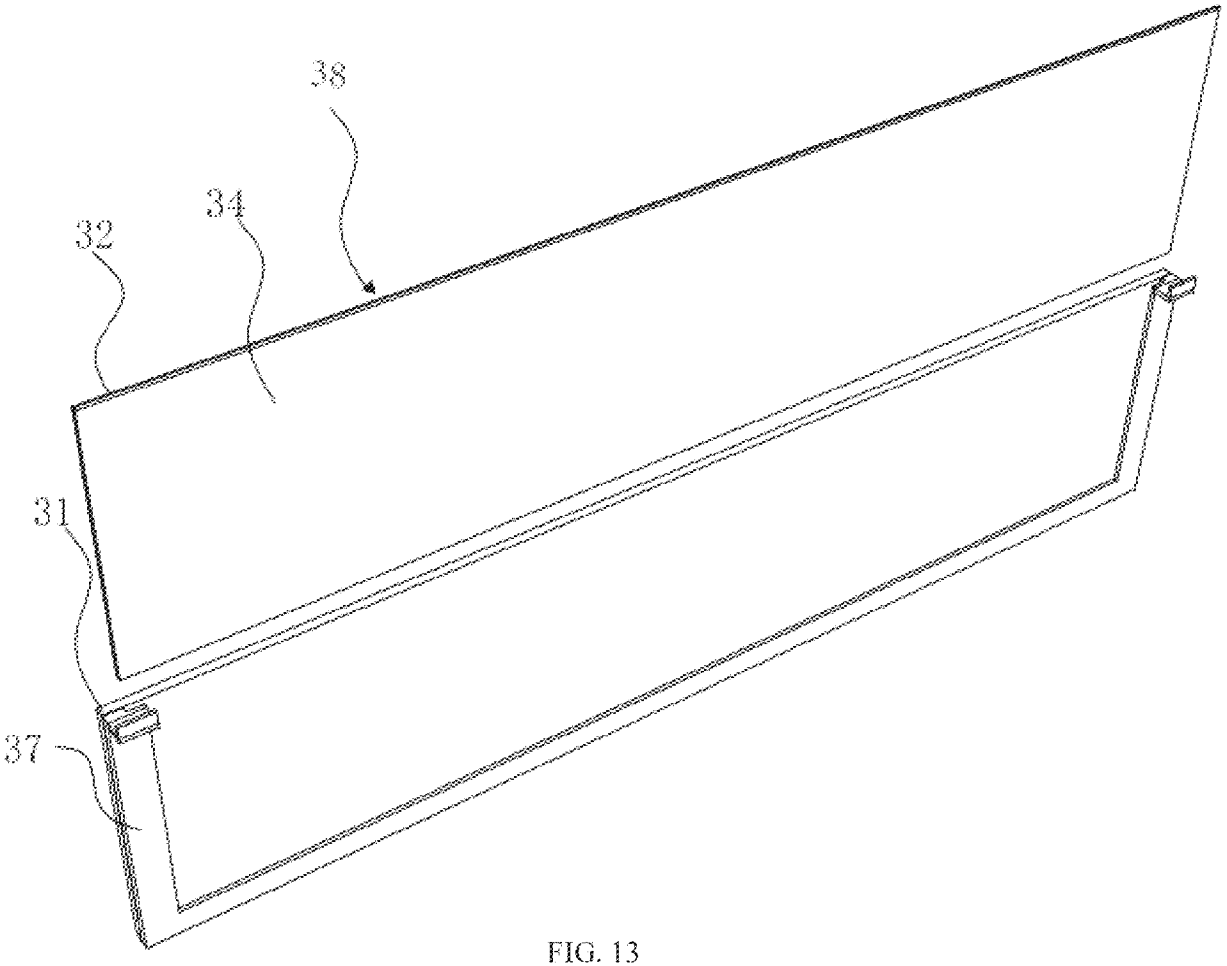
FIG. 13 shows a partially exploded view of the variable cover plate in FIG. 12.
Figure 14:
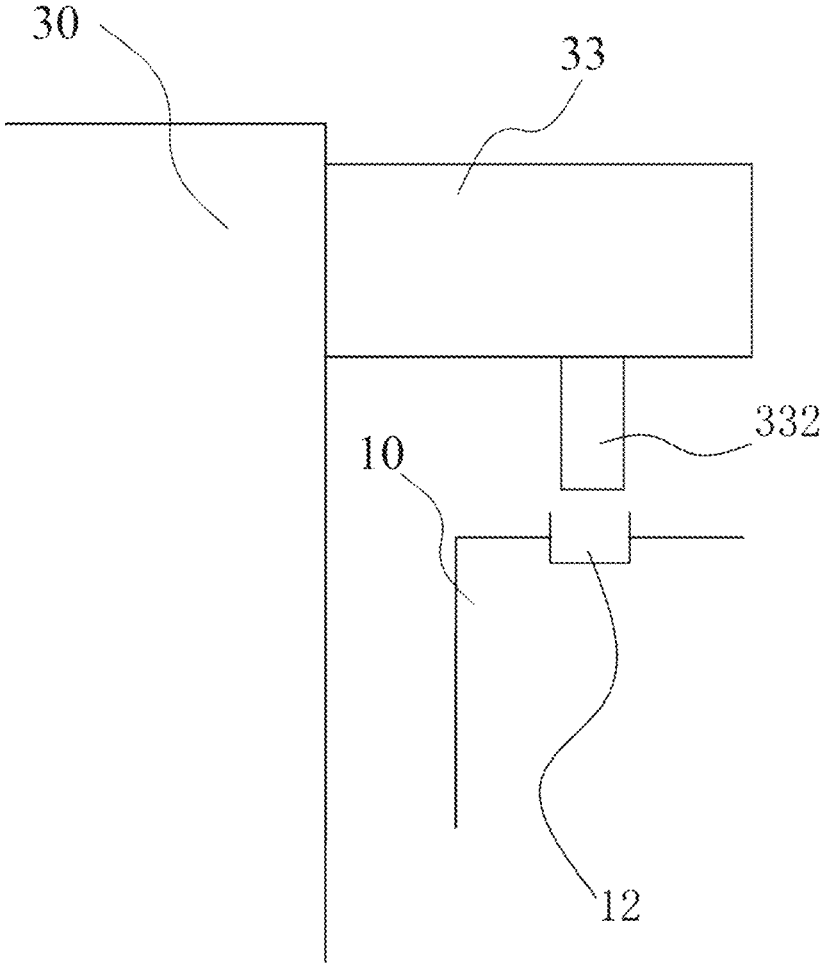
FIG. 14 illustrates a schematic diagram showing a connection of the variable cover plate to the housing in one embodiment of the present disclosure.

As shown in FIG. 12 to FIG. 14, the difference between the electric fireplace in embodiment I and that of embodiment II lies in the construction of the variable cover plate 30. Specifically, in embodiment I, the variable cover plate 30 comprises the outer transparent medium 31, the variable film 32, and the inner transparent medium 34, arranged in sequence from outside to inside. The connecting rack 35 is connected to the inner transparent medium 34. In contrast, in embodiment II, the variable film 32 is integrated with the inner transparent medium 34, creating an integral plate 38 configured to be mounted on a frame 37. And the the outer transparent medium 31 is disposed on the frame 37 independently. In some other embodiments of the disclosure, the integrated plate 38 comprises the variable film 32 and the outer transparent medium 31. And the inner transparent medium 34 is disposed on the frame 37 instead. Methods of connecting the integral plate 38 to the frame 37 involve plugging, fasteners, or various other ways.

Further, the variable cover plate 30 is provided with a connecting rack 35 disposed on the frame 37. In one embodiment of the present disclosure, the connecting rack 35 comprises a first fixing plate 351 with a through hole for receiving fasteners, the fasteners configured to fix the variable cover plate 30 to the housing 10. In one of the embodiments of the present disclosure, the connecting rack 35 further comprises a first notch 352 and a second notch 353 for clamping a first snap 14 and a second snap 15 on the housing 10, respectively, allowing the variable cover plate 30 to be correctly connected to the housing 10.

Additionally, other embodiments of this disclosure depict how the variable cover plate 30 connects to the housing 10, as illustrated in FIG. 14. In this figure, an interface 12 is disposed on top of the housing 10 to accept pin 332 extending vertically downward from the wire contact module 33. As a result, interface 12 not only supplies power to variable cover plate 30 but also improves the connection between variable cover plate 30 and the housing 10, reducing the need for additional positioning components and enhancing the design of the electric fireplace presented in this disclosure.

It should be noted that descriptions in the present disclosure such the description of "first", "second", "a", etc. are used for descriptive purposes only and are not to be construed as indicating or implying their relative importance or implicitly specifying the number of technical features indicated. It cannot be construed as indicating or implying the relative importance or implicitly specifying the number of technical features indicated. Thus, a feature defined with "first" or "second" may include at least one such feature, either explicitly or implicitly. In the description of the invention, "plurality" means at least two, e.g., two, three, etc., unless otherwise expressly and specifically limited. The terms "connected", "fixed", etc. are to be understood in a broad sense, e.g., "fixed" may be a fixed connection, a removable connection, or a one-piece unit; it may be a mechanical connection, or an electrical connection; it may be a direct connection; it may be an electrical connection; it may be a direct connection. It may be an electrical connection; it may be a direct connection or an indirect connection through an intermediary medium; it may be a connection within two elements or an interactive relationship between two elements, unless otherwise expressly limited. For those of ordinary skill in the art, the specific meanings of the above terms in the present invention may be understood according to the specific circumstances.

In addition, the technical solutions between the various embodiments of the present disclosure may be combined with each other, but it must be based on the fact that the person of ordinary skill in the field is able to realize it, and when the combination of the technical solutions appears to be contradictory or unattainable it should be assumed that such a combination of the technical solutions does not exist, and is not in the scope of protection of the claims of the present disclosure.

The specific embodiments described herein are merely illustrative of the spirit of the present disclosure. Those skilled in the art to which the present disclosure belongs may make various modifications or additions to the specific embodiments described or adopt similar substitutions, but will not deviate from the spirit of the present disclosure or exceed the scope defined in the append claims.

What is claimed is:

1. An electric fireplace with variable cover plate, comprising a housing, a variable cover plate, and an electronic control system, wherein the housing comprises an interior chamber configured to house simulated fuel;

the variable cover plate is detachably mounted on the housing for covering an opening of the interior chamber; and the electronic control system is configured to adjust the light transmittance of the variable cover plate to present different light and dark states of the interior chamber.

2. The electric fireplace of claim 1, wherein the variable cover plate comprises a variable film and a transparent medium, the variable film being disposed on the transparent medium and connected to a wire contact module, the electronic control system is configured to control a blurriness coefficient of the variable film via the wire contact module, such that the light transmittance of the variable cover plate is adjusted.

3. The electric fireplace of claim 2, wherein the electronic control system comprises a safety button and an interface configured to connect the wire contact module, the safety button configured to control the power on and off of the interface; when the safety button is in a pressed state, the power of the interface is on, and when the safety button is in a released state, the power of the interface is off.

4. The electric fireplace of claim 3, wherein the safety button is in a pressed state when and only when the opening of the interior chamber is covered by the variable cover plate.

5. The electric fireplace of claim 3, wherein the wire contact module comprises a base plate and a thimble connected to the base plate via an elastic component, the thimble comprising an axis, an elastic tolerance along the axis and an elastic tolerance perpendicular to the axis; the interface is configured to electrically connect to the thimble and comprises a recess for receiving and matching the thimble.

6. The electric fireplace of claim 2, wherein the transparent medium comprises at least two layers, an outer transparent medium and an inner transparent medium, and the variable film is disposed between the outer transparent medium and the inner transparent medium, the inner transparent medium facing the interior chamber.

7. The electric fireplace of claim 6, wherein the variable cover plate further comprises a frame configured to mount an integrated plate, the integrated plate being formed by laminating the variable film and the outer transparent medium, or by laminating the variable film and the inner transparent medium.

8. The electric fireplace of claim 7, wherein the variable cover plate is provided with a connecting rack disposed on the frame, the connecting rack comprising at least one fixing plate comprising a through hole for receiving fasteners, the fasteners configured to fix the variable cover plate to the housing; the connecting rack further comprises at least one notch for clamping corresponding snap joint on the housing, allowing the variable cover plate to be correctly connected to the housing.

9. The electric fireplace of claim 6, wherein the variable cover plate is provided with a connecting rack disposed on the inner transparent medium, the connecting rack comprising at least one fixing plate comprising a through hole for receiving fasteners, the fasteners configured to fix the variable cover plate to the housing; the connecting rack further comprises at least one notch for clamping corresponding snap joint on the housing, allowing the variable cover plate to be correctly connected to the housing.

* * * * *